United States Patent [19]

Thomas et al.

[11] Patent Number: 5,058,247

[45] Date of Patent: Oct. 22, 1991

[54] MECHANICAL FASTENING PRONG

[75] Inventors: Dennis A. Thomas, Cincinnati; Ted L. Blaney, West Chester, both of Ohio

[73] Assignee: The Proctor & Gamble Company, Cincinnati, Ohio

[21] Appl. No.: 564,672

[22] Filed: May 1, 1990

Related U.S. Application Data

[63] Continuation of Ser. No. 304,986, Jan. 31, 1989, abandoned.

[51] Int. Cl.[5] ..... A44B 18/00

[52] U.S. Cl. ..... 24/448; 24/450; 24/452

[58] Field of Search ..... 428/100; 24/442–452, 24/601.7, 601.8, 698.2, 698.3

[56] References Cited

U.S. PATENT DOCUMENTS

| | | | |
|---|---|---|---|
| 392,363 | 11/1888 | Riggs | 24/601.7 X |
| 569,213 | 10/1896 | Lehnig | 24/601.7 X |
| 625,022 | 5/1899 | Grist | 24/601.8 X |
| 2,717,437 | 9/1955 | de Mestral . | |
| 3,130,111 | 4/1964 | Izumi . | |
| 3,154,837 | 11/1964 | de Mestral . | |
| 3,266,113 | 8/1966 | Flanagan, Jr. . | |
| 3,426,400 | 2/1969 | Lauro | 24/601.7 |
| 3,550,837 | 12/1970 | Erb . | |
| 3,643,316 | 2/1972 | Girard et al. . | |
| 3,708,833 | 1/1973 | Ribich et al. . | |
| 3,943,981 | 3/1976 | De Brabander . | |
| 4,056,659 | 11/1977 | de Navas Albareda . | |
| 4,169,303 | 10/1979 | Lemelson | 428/100 X |
| 4,307,493 | 12/1981 | Ochiai . | |
| 4,330,907 | 5/1982 | Ochiai . | |
| 4,454,183 | 6/1984 | Wollman . | |
| 4,462,784 | 7/1984 | Russell . | |
| 4,776,068 | 10/1988 | Smitlock et al. | 24/444 X |
| 4,794,028 | 12/1988 | Fischer | 428/100 |
| 4,829,641 | 5/1989 | Williams . | |

FOREIGN PATENT DOCUMENTS

| | | |
|---|---|---|
| 2432108 | 7/1978 | France . |

*Primary Examiner*—James R. Brittain

*Attorney, Agent, or Firm*—Steven W. Miller; Larry L. Huston; Fredrick H. Braun

[57] ABSTRACT

An improved releasably securable fastening system for attaching to a complementary receiving surface is disclosed. The fastening system features an engaging means in the form of a hook-shaped tine. The engaging means is longitudinally spaced away from, or above, a substrate by an upstanding shank. The engaging means forms an included angle, relative to the perpendicular from the plane of the substrate, which is greater than 180° so that the engaging means has a reentrant segment. The reentrant segment of the engaging means provides for more effective securing of the fastening system to a receiving surface. An engaging means having an included angle greater than 180° provides improved resistance to forces which cause separation of the engaging means from the receiving surface.

12 Claims, 4 Drawing Sheets

Fig. 3
PRIOR ART
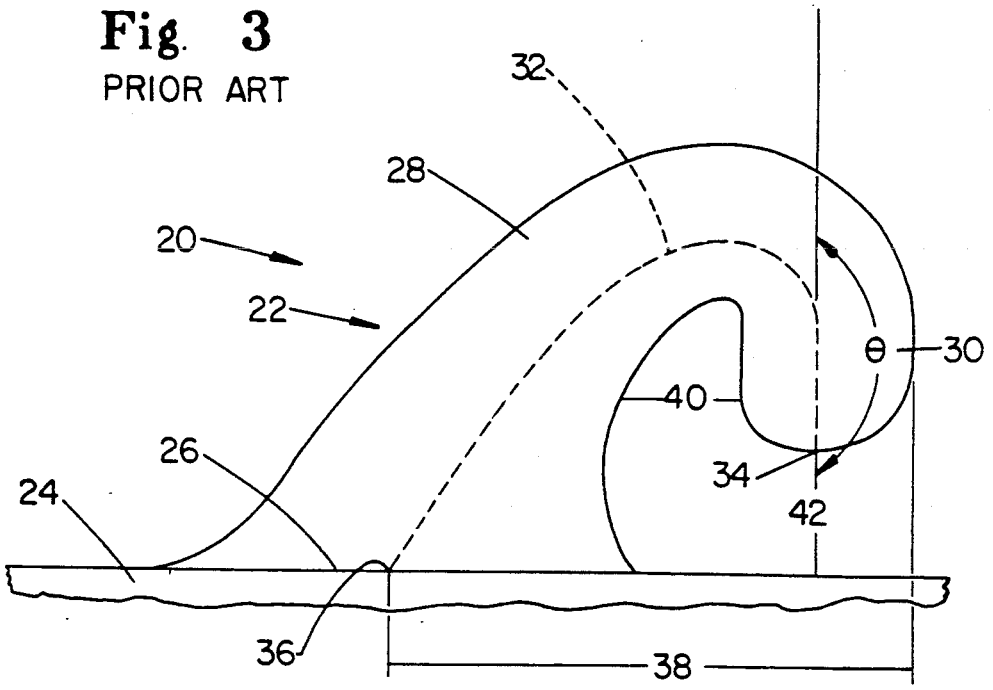
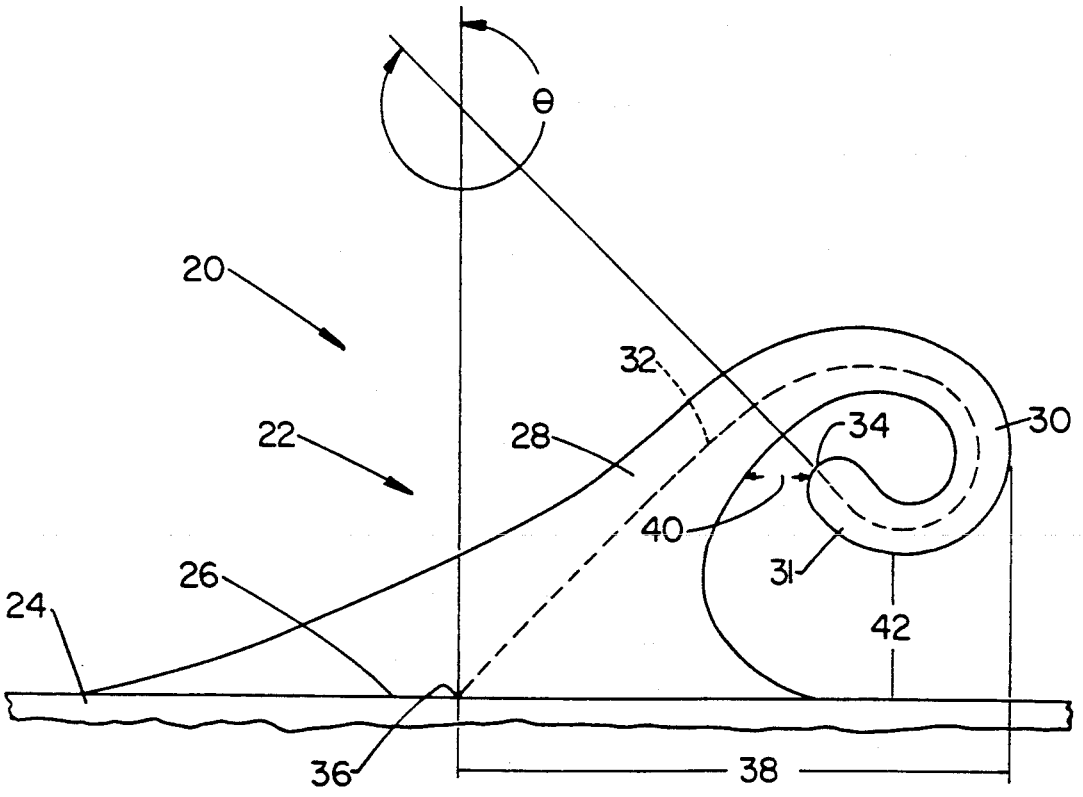
Fig. 4

MECHANICAL FASTENING PRONG

This is a continuation of application Ser. No. 07/304,986, filed on Jan. 31, 1989, abandoned.

FIELD OF THE INVENTION

The present invention relates to refastenable mechanical fastening systems, and more particularly to the prong of a mechanical fastening system, and still more particularly to a prong having an improved engaging means which more effectively engages to a complementary receiving surface.

BACKGROUND OF THE INVENTION

Releasably securable mechanical fastening systems are well known in the art. Such fastening systems are commonly used to secure two articles together. The fastening system has a substrate and at least one prong comprising a base, shank and engaging means. The prong is joined to the substrate at the base. Contiguous with the base of the prong is the shank, which projects outwardly from the base and substrate. Joined to the shank in spaced relation from the substrate is the engaging means. The engaging means projects laterally from the periphery of the shank and has a surface facing towards the substrate.

Securing of the two articles is accomplished by the engaging means intercepting fibers, strands, or induced localized deformations of a complementary receiving surface. When secured together, the physical obstruction, and resulting mechanical interference, between the engaging means of the fastening system and the fibers, strands or localized deformations of the receiving surface prevents release of the two articles until applied separation forces, such as peel and shear, exceed the resistance of the fastening system and receiving surface to such forces.

One of more significant factors determining the resistance to separation forces the fastening system and receiving surface can withstand without release and separation occurring is the included angle of the engaging means. The included angle is the angular deviation of the engaging means from the perpendicular to the substrate which passes through the center of the base of the prong.

A plethora of engaging means are used with presently known refastenable mechanical fastening systems. For example, one well known type of engaging means incorporates hemispherically shaped heads with a planar surface oriented towards the substrate and are typically referred to as being "mushroom-shaped." Such engaging means are generally illustrated in U.S. Pat. No. 4,216,257, issued Aug. 5, 1980 to Schams et al., U.S. Pat. No. 4,338,800, issued July 13, 1982 to Matsuda and European Patent Application Publication No. 0,276,970, filed Jan. 26, 1988 by the Procter & Gamble Company in the name of Scripps. In such embodiments, however, the engaging means have included angles from about 90° to about 165°, depending on the orientation of the stem of the prong relative to the substrate.

Another type of mechanical fastening system utilizes prongs which are cut from a loop and are hook shaped, somewhat resembling a candy cane, as illustrated in U.S. Pat. Nos. 3,083,737, issued Apr. 2, 1963 to de Mestral, 3,154,837, issued Nov. 3, 1964 to de Mestral and 3,943,981, issued Mar. 16, 1976 to De Brabander. Hook type fastening systems generally have included angles of about 180° or less, depending upon where the loop used to form the fastening system is cut. Hook-shaped fastening means produced by methods other than the cut loop system are disclosed in U.S. Pat. Nos. 3,629,032, issued Dec. 21, 1971 to Erb and 3,594,863, issued July 27, 1971 to Erb. These fastening means also have included angles of about 180°.

Various other structures are also taught as suitable for use as the engaging means of the fastening system. For example, U.S. Pat. Nos. 3,550,837, issued Dec. 29, 1970 to Erb, 3,708,833, issued Jan. 9, 1973 to Ribich et al. and 4,454,183, issued June 12, 1984 to Wollman disclose alternative types of engaging means, none of which have an included angle of greater than 180°.

It is an object of this invention to provide a fastening system which more securely engages or intercepts the strands or fibers of the receiving surface to resist applied separation forces. It is also an object of this invention to provide a fastening system having an engaging means with an included angle substantially greater than about 180° and a reentrant segment.

BRIEF SUMMARY OF THE INVENTION

The present invention relates to a fastening system for attaching to a complementary receiving surface. The fastening system has a substrate and at least one prong having a base, shank and engaging means. The prong is joined to the substrate at the base. The shank of the prong is contiguous with and projects longitudinally outwardly from the base of the prong and the substrate. The engaging means of the prong is joined to the shank of the prong and laterally projects radially outwardly from the periphery of said shank. The engaging means has an included angle substantially greater than about 180° and a reentrant segment.

In one execution, the engaging means has a first laterally projecting segment and a reentrant second laterally projecting segment. The first laterally projecting segment projects radially outwardly beyond the periphery of the shank. The laterally projecting reentrant second segment projects towards the shank of the prong, so that the engaging means defines a free space between the first segment and the reentrant segment. A longitudinal projection originating from and within the free space and oriented towards and generally perpendicular to the plane of the substrate intercepts one of the lateral segments.

In a second execution, the engaging means has first, second and third segments. The first segment laterally projects radially outwardly beyond the periphery of the prong. The second segment is joined to the first segment and longitudinally projects relative to the first segment. The third segment is joined to the second segment and laterally projecting towards the shank. A free space is defined between the segments of the engaging means. A longitudinal projection originating from and within the free space and oriented towards and generally perpendicular to the plane of the substrate intercepts one of the lateral segments.

BRIEF DESCRIPTION OF THE DRAWINGS

While the Specification concludes with claims particularly pointing out and distinctly claiming the present invention, it is believed the invention will be better understood from the following Specification taken in conjunction with the associated drawings in which like elements are designated by the same reference numeral and:

FIG. 3 is a side elevational profile view of a prong having an engaging means with an included angle of about 180°;

FIG. 4 is a side elevational profile view of a prong of the fastening system of the present invention having an engaging means with an included angle of about 315°;

DETAILED DESCRIPTION OF THE INVENTION

Figure 1:
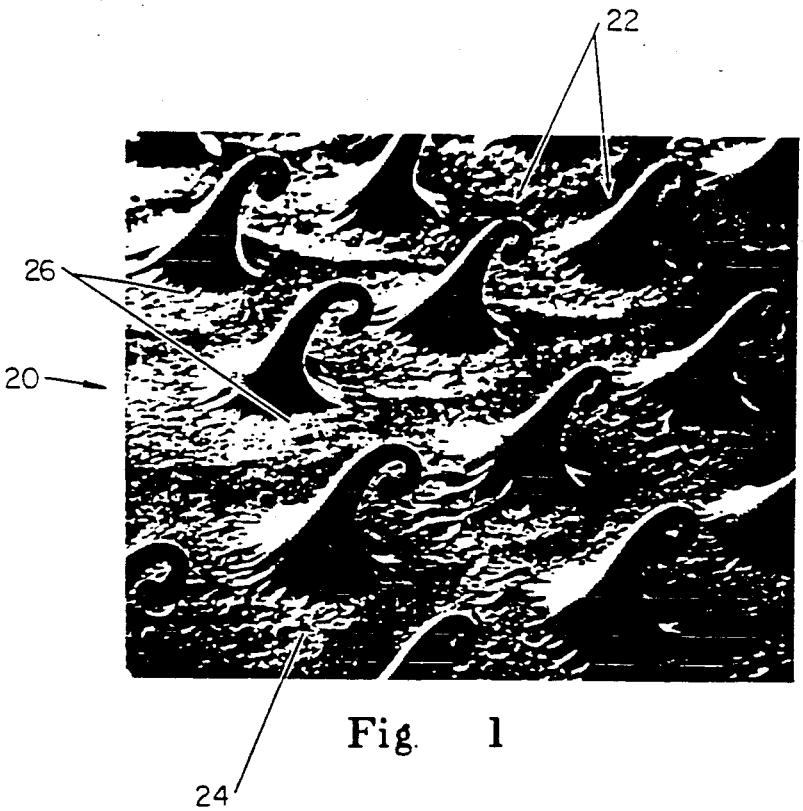
FIG. 1 is a perspective view of a fastening system of the present invention.

The fastening system 20 of the present invention comprises at least one prong 22, and preferably an array of prongs 22, joined to a substrate 24 in a predetermined pattern as shown in FIG. 1. Each prong 22 has a base 26, shank 28, and engaging means 30. The bases 26 of the prongs 22 contact and adhere to the substrate 24, and support the proximal ends of the shanks 28. The shanks 28 project outwardly from the substrate 24 and bases 26. The shanks 28 terminate at a distal end which is joined to an engaging means 30. The engaging means 30 radially project laterally beyond the shanks 28 in one or more directions and may resemble a hook-shaped tine. As used herein, the term "lateral" means having a vector component generally parallel to the plane of the substrate 24 at the principal prong 22 under consideration. The projection of an engaging means 30 beyond the shank 28 periphery in a lateral direction allows the engaging means 30 to be secured to a complementary receiving surface (not shown).

The fastening system 20 is secured to a complementary receiving surface. As used herein, the term "receiving surface" to which the engaging means 30 of the fastening system 20 are secured refers to any plane or surface which will interact with the engaging means such that the engaging means may not be readily separated from the receiving surface. The receiving surface may have an exposed face with tightly spaced openings complementary to the engaging means 30 and defined by one or more strands or fibers. Alternatively, the exposed face may be capable of localized elastic deformation so that the engaging means 30 may become entrapped and not withdrawn without interference.

Figure 2:
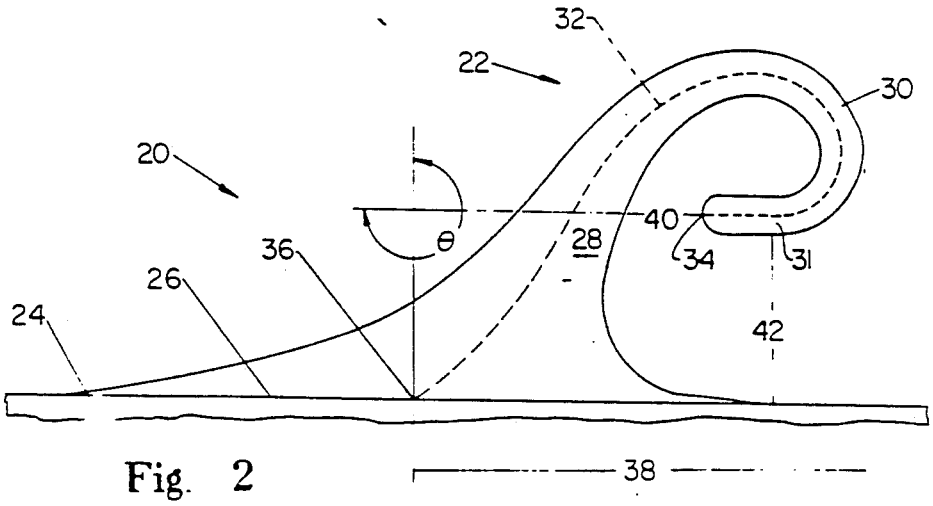
FIG. 2 is a side elevational profile view of a prong of the fastening system of the present invention having an engaging means with an included angle of about 270°.

Referring to FIG. 2 to examine the components of the fastening system 20 in more detail, the substrate 24 of the fastening system 20 is preferably a sheet of material to which the prongs 22 are attached in a desired pattern. The "substrate" is any exposed surface to which one or more prongs 22 are joined. The substrate 24 should be strong enough to preclude tearing and separation between individual prongs 22 of the fastening system 20. In addition, the substrate 24 is manufactured from a material which is capable of being joined to the prongs 22 and which is further capable of being joined to an article to be secured as desired by a user. As used herein the term "join" refers to the condition where a first member, or component, is affixed, or connected to a second member or component, either directly; or indirectly, where the first member or component is affixed or connected to an intermediate member, or component which in turn is affixed, or connected, to the second member or component. The association between the first member, or component, and the second member, or component, is intended to remain for the life of the article.

The substrate 24 should also be capable of being rolled, to support conventional manufacturing processes, flexible so that the substrate 24 may be bent or flexed in a desired configuration, and able to withstand the heat of the liquid prongs 22 being deposited thereon without melting or incurring deleterious effects until such prongs 22 freeze. The substrate 24 should also be available in a variety of widths. Suitable substrates 24 include knitted fabric, woven materials, nonwoven materials, films, particularly polyolefinic films and preferably kraft paper. White kraft paper having a basis weight of about 0.08 kilograms per square meter (50 pounds per 3,000 square feet) has been found suitable.

The base 26 of the prong 22 comprises the plane of attachment to the substrate 24 and is contiguous with the proximal end of the shank 28. As used herein, the term "base" refers to that portion of the prong 22 which is in direct contact with the substrate 24 and supports the shank 28 of the prong 22. The shape of the footprint of the base 26 on the substrate 24 is not critical, and may be amplified in any direction to provide a greater peel strength in that direction. As used herein, the term "footprint" refers to the planar contact area of the base 26 on the substrate 24. A generally circular shaped footprint is preferred. For the embodiment described herein, a footprint of generally circular shape and approximately 0.76 millimeters to 1.27 millimeters (0.030 to 0.050 inches) in diameter is suitable.

The shank 28 is contiguous with the base 26 and projects outwardly from the base 26 and substrate 24. As used herein, the term "shank" refers to that portion of the prong 22 which is contiguous with the base 26 and intermediate the base 26 and the engaging means 30. The shank 28 provides longitudinal spacing of the engaging means 30 from the substrate 24. As used herein, the term "longitudinal" means in a direction having a vector component away from the substrate 24, which direction increases the perpendicular distance to the plane of the substrate 24 at the base 26 of the prong 22, unless otherwise specified to be a direction having a vendor component towards such plane of the substrate 24.

Associated with each prong 22 is a longitudinal axis 32. As used herein, the term "longitudinal axis" refers to an imaginary line generally centered at the footprint of the base 26 and laterally and longitudinally projecting through the distal end of the shank 28 to the tip 34 of the engaging means 30. The prong base 26, shank 28 and engaging means 30 are generally concentric with the longitudinal axis 32 if the prong 22 cross section is of a regular shape. If the cross section of the prong 22 is irregularly shaped, the longitudinal axis 32 is disposed at the centroid of any cross section.

The "origin" of the longitudinal axis 32 is the point of intersection between the longitudinal axis 32 and the base 26, and is typically within the footprint of the base 26. Specifically, the origin 36 is the center of the smallest circle which circumscribes the footprint of the base 26.

After the origin 36 of the prong 22 has been found, the origin 36 may be used to determine the profile view of the prong 22. The "side view" is any direction radially directed towards the longitudinal axis 32 of the shank 28, particularly the perpendicular which passes through the origin 36, and parallel to the plane of the substrate 24. The "profile view" of the prong 22 is one of two particular side views and found as follows. The prong 22 is visually inspected from the side views such that the direction having the maximum lateral projection 38 becomes apparent. The "lateral projection" is the distance taken laterally and parallel to the plane of the substrate 24 from the origin 36 of the shank 28, to the projection of the furthest laterally remote point on the prong 22 visible in such view when such point is longitudinally and perpendicularly projected downward to the plane of the substrate 24.

It will be apparent to one skilled in the art that the maximum lateral projection 38 is that projection from the origin 36 to the outer periphery of the shank 28 or engaging means 30. The side view of the prong 22 which maximizes the lateral projection 38 is the profile view of such prong 22. It will also be apparent to one skilled in the art that if the fastening system 20 is produced by the process described below, the maximum lateral projection 38 is generally oriented in the machine direction and, hence, the profile view is generally oriented in the cross-machine direction. The side elevational view shown in the figures is one of the profile views of the prong 22. It will be further apparent to one skilled in the art that there is another profile view, generally 180° opposite from the profile view shown (so that the maximum lateral projection 38 is oriented towards the left of the viewer). Either of the two profile views is generally equally well suited for the procedures and usages described hereinbelow.

The engaging means 30 of the prong may have a greater lateral projection 38 than the prong shank 28, or vice-versa, as desired. The engaging means 30 preferably may have a reentrant curve and longitudinally approximate the substrate 24 at the prong base 26 or a location laterally spaced from the prong base 26.

The engaging means 30 forms an included angle $\theta$ relative to the plane of the substrate 24. As used herein, the term "included angle $\theta$" refers to the angular deviation between the extension of the perpendicular to the plane of the substrate 24 which passes through the origin 36 of base 26 and the projection of the longitudinal axis 32 through the tip 34 of the engaging means 30, as seen when the prong 22 is viewed in profile. The phrase "projection of the longitudinal axis" refers to the imaginary continuation of the longitudinal axis 32 in a straight line through the tip 34 of the engaging means 30 is such axis were continued at the angle present at the tip 34 of the engaging means 30. Various included angles $\theta$ are illustrated by the examples shown in Table I;

TABLE 1

| Angle | Description |
|---|---|
| $\theta = 0°$ | The projection of the longitudinal axis 32 is perpendicular to and directed away from the plane of the substrate 24 and lies coincident with the perpendicular which passes through the origin 36. |
| $0° \leqq \theta \leqq 90°$ | $\theta$ equals the angle between the projection of the longitudinal axis 32 and the outwardly oriented perpendicular which passes through the origin 36. |
| $\theta = 90°$ | The projection of the longitudinal axis 32 is parallel to the plane of the substrate 24 and oriented radially away from the perpendicular which passes through the origin 36. |
| $90° \leqq \theta \leqq 180°$ | $\theta$ equals 90° plus the deviation of the projection of the longitudinal axis 32 below the plane tangent to the highest elevation of the longitudinal axis 32 and parallel to the plane of the substrate 24. |
| $\theta = 180°$ | The projection of the longitudinal axis 32 is perpendicularly oriented towards the plane of the substrate 24 and laterally offset from the origin 36. |
| $180° \leqq \theta \leqq 270°$ | $\theta$ equals 180° plus the deviation of the projection of the longitudinal axis 32 from the perpendicular (either the perpendicular tangent to the tip 34 of the longitudinal axis 32 and directed towards the plane of substrate 24 or the perpendicular through the origin 36 and oriented away from the plane of the substrate 24). |
| $\theta = 270°$ | The projection of the longitudinal axis 32 is parallel to the plane of the substrate 24 and laterally oriented towards the perpendicular which passes through the origin 36. |
| $270° \leqq \theta \leqq 360°$ | $\theta$ equals 270° plus the deviation of the projection of the longitudinal axis 32 from the plane of the substrate 24. |
| $\theta = 360°$ | The projection of the longitudinal axis 32 is perpendicular to the plane of the substrate 24, longitudinally outwardly oriented and laterally offset from the perpendicular which passes through the origin 36. |
| $\theta \geqq 360°$ | $\theta$ is found according to the methods discussed above, and 360° is added to the angle. |

It is to be recognized that as the included angle $\theta$ of the engaging means 30 increases, i.e. departs further from the perpendicular to the plane of the substrate 24, it will become increasingly difficult for the engaging means 30 to intercept the strands or fibers of the receiving surface. However, a strand entangled in an engaging means 30 having a relatively greater included angle $\theta$ is less likely to migrate out of or work free from the engaging means 30 during use.

For any of the embodiments described herein, the engaging means 30 has an included angle $\theta$ preferably substantially greater than about 180°. More preferably, the included angle is substantially greater than about about 180° and less than about 360°, even more preferably between about 230° and about 310°, and most preferably about 270°. An included angle $\theta$ greater than about 195° is considered to be substantially greater than about 180°.

The engaging means 30 has a reentrant segment 31 if the included angle $\theta$ of the engaging means 30 is substantially greater than about 180°. The "reentrant segment" is that portion of the engaging means 30 which extends beyond an included angle $\theta$ substantially greater than about 180°. Thus, if the engaging means 30 is truncated to have an included angle $\theta$ of about 180°, the reentrant segment 31 is that portion of the engaging means 30 intermediate the plane of truncation and the tip 34. The reentrant segment 31 is directed laterally towards the shank 28, but it will be apparent that the reentrant segment 31 need not be radially oriented towards the perpendicular which passes through the origin 36.

The prong 22 illustrated in FIG. 2 is a particularly preferred embodiment having an engaging means 30 which forms an included angle $\theta$ of about 270°. The prong illustrated in FIG. 3 has a relatively lesser included angle $\theta$ which is about 180°. The prong 22 illustrated in FIG. 4 has a relatively greater included angle $\theta$ of about 315°.

The prongs 22 of the fastening system 20 of the present invention may be made of any of the materials well known and commonly used in the art including plastics, such as thermoplastics. Hot melt adhesive thermoplastics are particularly well suited to the fastening system 20 of the present invention, particularly if the fastening system 20 is manufactured according to the process described hereinbelow. Polyester and polyamide hot melt adhesives have been found particularly suitable. A polyester hot melt adhesive marketed by the Bostik Company of Middleton, Mass., under Model No. 7199 has been found to work well. A polyamide hot melt adhesive marketed by the Henkel Company of Kankakee, Ill. under the tradename Macromelt 6300 has been found to work well.

Figure 5:
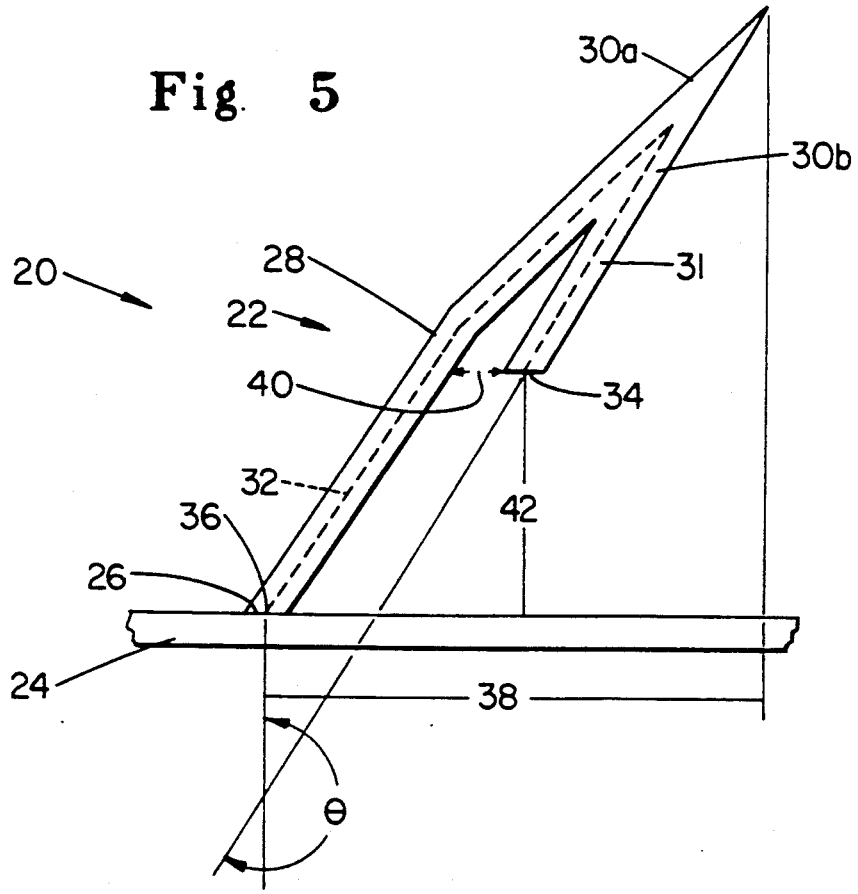
FIG. 5 is a side elevational profile view of a prong of the fastening system of the present invention having an engaging means with a first segment and a reentrant second segment.

Instead of being arcuately shaped, as illustrated in the figures, the prongs 22 may have more abrupt discontinuities or be segmented. In one such embodiment, illustrated in FIG. 5, the engaging means 30 may be schematically thought of as having two segments, a first segment 30*a* and a reentrant second segment 30*b*. The first segment 30*a* projects laterally and radially from the perpendicular which passes through the origin 36. The first segment 30*a* may be colinear with the shank 28, providing it is nonperpendicularly oriented relative to the plane of the substrate. If the first segment 30*a* and shank 28 are colinear, it is not necessary that a clear demarcation be apparent between the shank 28 and the first segment 30*a* of the engaging means 30, or that the terminus of the shank 28 or the first segment 30*a* be determinable at all. Whether or not the first segment 30*a* of the engaging means 30 is colinear with the shank 28, the first segment 30*a* projects radially outwardly beyond the periphery of the shank 28 and is joined to a laterally projecting reentrant second segment 30*b*.

The reentrant second segment 30*b* laterally projects back towards the shank 28 of the prong 22 and particularly towards the perpendicular which passes through the origin 36. The tip 34 of the reentrant second segment 30*b* of the engaging means 30 is laterally closer to the perpendicular which passes through the origin 36 than is the end of the second segment 30*b* which is joined to the first lateral segment 30*a*. It will be apparent, however, that the second lateral segment 30*b* may be longitudinally spaced towards (as shown) or away from (not illustrated) the plane of the substrate 24, relative to the first lateral segment 30*a*.

Either of the segmented arrangements defines a free space between the first lateral segment 30*a* and the reentrant lateral segment 30*b*. As used herein, the term "free space" refers to a plane, not parallel to and preferably generally perpendicular to the plane of the substrate 24, and at least partially bounded by the engaging means 30 of the prong 22. A longitudinal projection originating within the free space and oriented towards and generally perpendicular to the plane of the substrate 24 will intercept one of the lateral segments 30*a* or 30*b* which defines the free space, particularly the lateral segment 30*a* or 30*b* longitudinally closer towards the plane of the substrate 24. It will be apparent to one skilled in the art that the arcuate embodiments shown in FIGS. 2–4 also define a free space.

Figure 6:
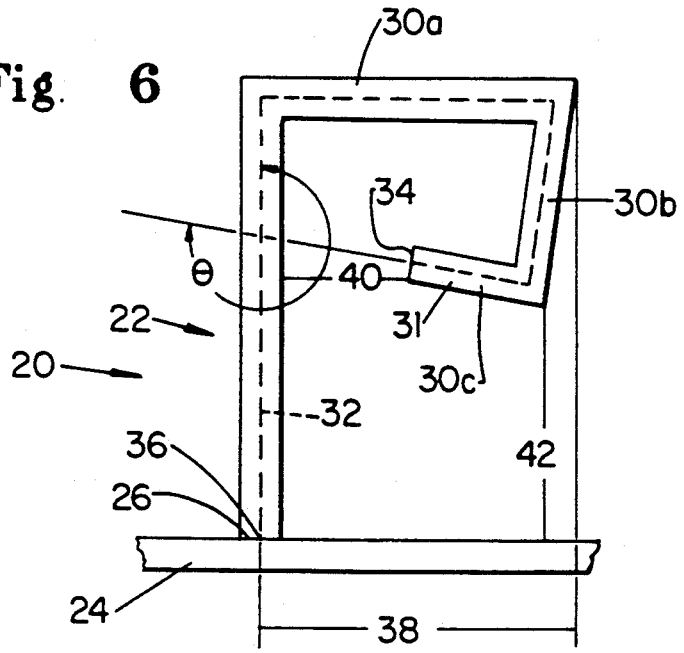
FIG. 6 is a side elevational profile view of a prong of the fastening system of the present invention having an engaging means with a first segment, a second segment and a reentrant third segment.

Alternatively, as illustrated in FIG. 6 the engaging means 30 may be schematically thought of as having three distinguishable segments 30*a*, 30*b* and 30*c*. The first segment 30*a* laterally projects radially outwardly beyond the periphery of the shank 28. The distal end of the first segment 30*a* is joined to a second segment 30*b* which projects longitudinally relative to the first segment 30*a* and the plane of the substrate 24. The second segment 30*b* may project longitudinally away from the plane of the substrate 24 or, preferably, longitudinally towards the plane of the substrate 24. The distal end of the second segment 30*b* is joined to a reentrant third segment 30*c* which laterally projects back towards the prong shank 28 so that the tip 34 of the third segment 30*c* is laterally closer to the perpendicular which passes through the origin 36 than is the end of the third segment 30*c* which is joined to the second segment 30*b*. As described above, a free space is defined between the three segments 30*a*, 30*b* and 30*c*. Also as described above, a longitudinal projection originating within the free space and oriented towards and generally perpendicular to the plane of the substrate 24 will intercept one of the lateral segments 30*a*, 30*b* or 30*c* which defines the free space, particularly the lateral segment 30*a*, 30*b* or 30*c* longitudinally closer towards the plane of the substrate 24.

It will be apparent to one skilled in the art that prongs 22 which do not have sharp discontinuities or other stress raisers are generally preferable. Thus, even the segmented arrangements illustrated in FIGS. 5 and 6 may be made more arcuate than is shown in these figures.

The openings or localized elastic deformations allow for entry of the engaging means 30 into the plane of the receiving surface, while the strands (or nondeformed material) of the receiving surface interposed between the openings (or deformed areas) prevents withdrawal or release of the fastening system 20 until desired by the user or either the peel or shear strength of the fastening system 20 is otherwise exceeded. The plane of the receiving surface may be flat or curved.

A receiving surface having strands or fibers, is said to be "complementary" if the openings between strands or fibers are sized to allow at least one engaging means 30 to penetrate into the plane of the receiving surface, and the strands are sized to be intercepted by the engaging means 30. A receiving surface which is locally deformable is said to be "complementary" if at least one engaging means 30 is able to cause a localized disturbance to the plane of the receiving surface, which disturbance resists removal or separation of the fastening system 20 from the receiving surface. Suitable receiving surfaces include reticulated foams, knitted fabrics, nonwoven materials, and stitchbonded loop materials, such as Velcro brand loop materials sold by Velcro USA of Manchester, N.H. A particularly suitable receiving surface is stitchbonded fabric Number 970026 sold by the Milliken Company of Spartanburg, S.C.

Referring back to FIG. 2, the free space defines the minimum lateral dimension 40 and minimum longitudinal dimension 42 of the engaging means 30. As used herein, the "minimum longitudinal dimension" is the shortest distance taken perpendicular to the plane of the substrate 24 through which a strand or fiber of the receiving surface must pass to enter the free space. If the engaging means 30 longitudinally projects toward the plane of the substrate 24, as shown in the figures, the minimum longitudinal dimension 42 is between the plane of the substrate 24 and the engaging means 30. Alternatively, if the engaging means 30 has a segment which longitudinally projects away from the plane of the substrate 24, the minimum longitudinal dimension 42 is between segments of the engaging means 30. For the embodiments and receiving surfaces described herein, prongs 22 with engaging means 30 having a minimum longitudinal dimension 42 of about 0.2 millimeters to about 0.08 millimeters (0.008 to 0.03 inches) is suitable.

Similarly, the "minimum lateral dimension" is the shortest distance, taken parallel to the plane of the substrate 24, through which a strand or fiber of the receiving surface must pass to enter the free space. The minimum lateral dimension 40 is formed between the engaging means 30 and shank 28, or between segments of the engaging means 30. For the embodiments and receiving surfaces described herein, prongs 22 with engaging means 30 having a minimum lateral dimension 40 of about 0.2 millimeters to about 0.8 millimeters (0.008 to 0.03 inches) is suitable. All of the prongs 22 illustrated in the figures have a greater minimum longitudinal dimension 42 than minimum lateral dimension 40.

PROCESS OF MANUFACTURE

Figure 7:
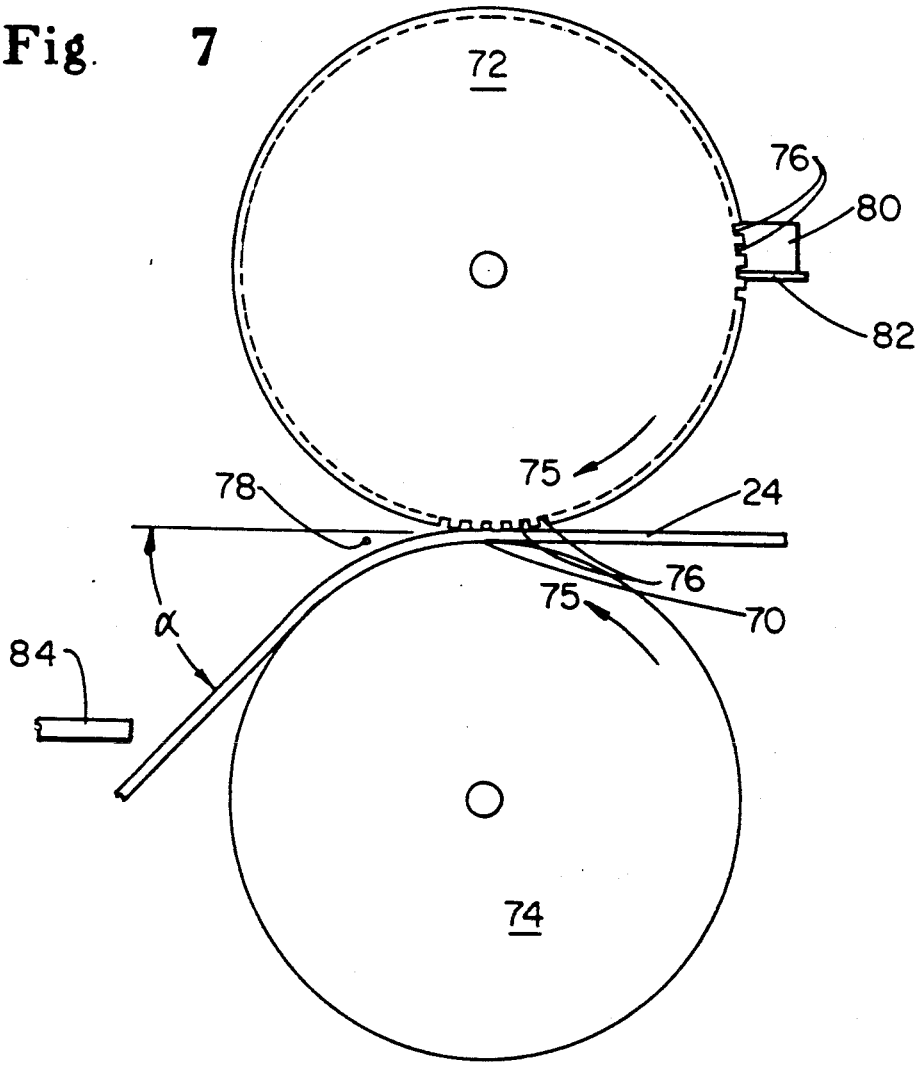
FIG. 7 is a side elevational schematic view of one apparatus which can be used to manufacture the fastening system of the present invention.

The fastening system 20 according to the present invention may be manufactured using a modified gravure printing process. Gravure printing is well known in the art as illustrated by U.S. Pat. No. 4,643,130 issued Feb. 17, 1988, to Sheath et al. and incorporated herein by reference to illustrate the general state of the art. Referring to FIG. 7, the substrate 24 is passed through the nip 70 formed between two rolls, a print roll 72 and a backing roll 74. The rolls 72 and 74 have substantially mutually parallel centerlines disposed generally parallel to the plane of the substrate 24. The rolls 72 and 74 are rotated about the respective centerlines and have generally equal surface velocities, in both magnitude and direction, at the nip point 70. If desired, both the print roll 72 and the backing roll 74 may be driven by an external motive force (not shown), or one roll driven by external motive force and the second roll driven by frictional engagement with the first roll. An alternating current electric motor having an output of about 1,500 watts provides adequate driving force. By rotating, the rolls 72 and 74 actuate a depositing means for depositing the prongs 22 onto the substrate 24.

The depositing means should be able to accommodate the temperature of the material of prongs 22 in the liquid state, provide substantially uniform pitch between the prongs 22 in both the machine and cross-machine directions and yield the desired density of prongs 22 within the array. Also, the depositing means should be able to produce prongs 22 having various diameters of the base 26 and heights of the shank 23. The print roll 72, specifically, provides for the depositing means to deposit the prongs 22 on the substrate 24 in a desired pattern according to the present manufacturing process. The phrase "depositing means" refers to anything which transfers liquid prong material from a bulk quantity to the substrate 24 in dosages corresponding to individual prongs 22. The term "deposit" means to transfer prong material from the bulk form and dose such material onto the substrate 24 in units corresponding to individual prongs 22.

One suitable depositing means for depositing prong material onto the substrate 24 is an array of cells 76 in the print roll 72. As used herein the term "cell" refers to any cavity, or other component of the print roll 72, which transfers prong material from a source to the substrate 24 and deposits this material onto the substrate 24 in discrete units.

The cross sectional area of the cell 76, taken at the surface of the print roll 72, generally corresponds with the shape of the footprint of the base 26 of the prong 22. The cross section of the cell 76 should be approximately equal to the desired cross section of the base 26. The depth of the cell 76, in part, determines the longitudinal length of the prong 22, specifically the perpendicular distance from the base 26 to the point or segment of highest elevation. However, as the depth of the cell 76 increases to more than approximately 70 percent of the diameter of the cell 76, the longitudinal dimension of the prong 22 generally remains constant. This is because not all of the liquid prong material is pulled out of the cell 76 and deposited on the substrate 24. Due to the surface tension and viscosity of the liquid prong material, some of it will remain in the cell 76 and not be transferred to the substrate 24.

For the embodiment described herein, a blind, generally cylindrically shaped cell 76 having a depth between about 50 and about 70 percent of the diameter is adequate. If desired, the cell 76 may be somewhat frustroconically tapered in shape to accommodate conventional manufacturing processes, such as chemical etching.

If frustroconically shaped, the included angle of the taper of the cell 76 should be no more than about 45° to produce a preferred taper of the shank 28. If the taper of the cell 76 has a greater included angle, a prong 22 having too much taper may result. If the included angle of the taper is too small, or the cell 76 is cylindrical, a shank 28 of generally uniform cross section may result, and thereby have areas of higher stress. For the embodiment described herein a cell 76 having an angle of taper of about 45°, a diameter at the roll periphery of about 0.89 millimeters to about 1.22 millimeters (0.035 to 0.048 inches) and a depth ranging from about 0.25 millimeters to about 0.51 millimeters) 0.01 to 0.02 inches produces a suitable prong 22.

The print roll 72 and backing roll 74 should be compressed, coincident with the line connecting the centerlines of the rolls 72 and 74, to press the adhesive from the cells 76 in the print roll 72 onto the substrate 24 and to provide sufficient frictional engagement to drive the opposing roll if it is not externally motivated. The backing roll 74 is preferably somewhat softer and more compliant than the print roll 72 to provide cushioning of the prong material as it is deposited on the substrate 24 from the print roll 72. A backing roll 74 having a rubber coating with a Shore A durometer hardness of about 40 to about 60 is suitable. The rolls 72 and 74 may be pressed together with such a force that an impression in the machine direction of about 6.4 millimeters to about 12.7 millimeters (0.25 to 0.50 inches) is obtained. As used herein the term "impression" refers to the contact area of the softer roll on the substrate 24 as it passes through the nip 70.

The print roll 72 temperature is not critical, however, preferably, the print roll 72 is heated to prevent solidification of the prongs 22 during transfer from the source through the deposition on the substrate 24. Generally a print roll 72 surface temperature near the source material temperature is desired. A print roll 72 temperature of about 197° C. has been found to work well.

It is to be recognized that a chill roll may be necessary if the substrate 24 is adversely affected by the heat transferred from the prong material. If a chill roll is desired, it may be incorporated into the backing roll 74 using means well known to one skilled in the art. This arrangement is often necessary if a polypropylene or polyethylene substrate 24 is used.

The material used to form the individual prongs 22 must be kept in a source which provides for the proper temperature to apply the prongs 22 to the substrate 24. Typically, a temperature slightly above the melting point of the material is desired. The material is considered to be at or above the "melting point" if the material is wholly in the liquid state. If the source of the prong material is kept at too high a temperature, the prong material may not be viscous enough and may produce engaging means 30 which laterally connect to the prongs 22 adjacent in the machine direction. If the material temperature is very hot, the prong 22 will flow into a small, somewhat semispherically shaped puddle and an engaging means 30 will not be formed. Conversely, if the source temperature is too low, the prong material may not transfer from the source to the depositing means 76 or, subsequently, may not properly transfer from the depositing means 76 to the substrate 24 in the desired array or pattern. The source of the material should also impart a generally uniform cross-machine direction temperature profile to the material, be in communication with the depositing means 76 and easily be replenished or restocked as the prong material becomes depleted.

A suitable source is a trough 80, substantially coextensive of that portion of the cross-machine dimension of the print roll 72 which has cells 76 and adjacent thereto. The trough 80 has a closed end bottom, an outboard side and ends. The top may be open or closed as desired. The inboard side of the trough 80 is open, allowing the liquid material therein to freely contact and communicate with the circumference of the print roll 72.

The source is externally heated by known means (not shown) to maintain the prong material in a liquid state and at the proper temperature. The preferred temperature is above the melting point but below that at which a significant loss of viscoelasticity occurs. If desired, the liquid material inside the trough 80 may be mixed or recirculated to promote homogeneity and an even temperature distribution.

Juxtaposed with the bottom of the trough 80 is a doctor blade 82 which controls the amount of prong material applied to the print roll 72. The doctor blade 82 and trough 80 are held stationary as the print roll 72 is rotated, allowing the doctor blade 82 to wipe the circumference of the roll 72 and scrape any prong material which is not disposed within the individual cells 76 from the roll 72 and allows such material to be recycled. This arrangement allows prong material to be deposited from the cells 76 to the substrate 24 in the desired array, according to the geometry of the cells 76 on the circumference of the print roll 72. As seen in FIG. 7, the doctor blade 82 is preferentially disposed in the horizontal plane, particularly the horizontal apex of the print roll 72, which horizontal apex is immediately upstream of the nip 70.

After being deposited onto the substrate 24, the prongs 22 are severed from the print roll 72 and the depositing means 76 by a severing means for severing 78 the prongs 22 into the engaging means 30 of the fastening system 20 and a moil. As used herein the term "moil" refers to any material severed from the prong 22 and which does not form part of the fastening system 20.

The severing means 78 should be adjustable to accommodate various sizes of prongs 22 and lateral projections 38 of engaging means 30 and also provide uniformity throughout the cross-machine direction of the array. The term "severing means" refers to anything which longitudinally separates the moil from the fastening system 20. The term "sever" refers to the act of dividing the moil from the fastening system 20 as described above. The severing means 78 should also be clean and should not rust, oxidize or impart corrodents and contaminates (such as moil material) to the prongs 22. A suitable severing means is a wire 78 disposed generally parallel to the axis of the rolls 72 and 74 and spaced from the substrate 24 a distance which is somewhat greater than the perpendicular distance from the highest elevation of the solidified prong 22 to the substrate 24.

Preferably the wire 78 is electrically heated to prevent build-up of the molten prong material on the severing means 78, accommodate any cooling of the prongs 22 which occurs between the time the prong material leaves the heated source and severing occurs and promote lateral stretching of the engaging means 30. The heating of the severing means 78 should also provide for uniform temperature distribution in the cross-machine direction, so that an array of prongs 22 having substantially uniform geometry is produced.

Generally, as the prong material temperature increases, a relatively cooler hot wire 78 temperature severing means can be accommodated. Also, as the speed of the substrate 24 is decreased, less frequent cooling of the hot wire 78 occurs as each prong 22 and moil are severed, making a relatively lower wattage hot wire 78 more feasible at the same temperatures. It should be recognized that as the temperature of the hot wire 78 is increased a prong 22 having a generally shorter shank 28 length will result. Conversely, the shank 28 length and lateral length of the engaging means 30 will be increased in inverse proportion as the temperature of the hot wire 78 is decreased. It is not necessary that the severing means 78 actually contact the prong 22 for severing to occur. The prong 22 may be severed by the radiant heat emitted from the severing means 78.

For the embodiment described herein, a round cross section nickel-chromium wire 78, having a diameter of about 0.51 millimeters (0.02 inches) heated to a temperature of about 343° C. to about 416° C. has been found suitable. It will be apparent that a knife, laser cutting or other severing means 78 may be substituted for the hot wire 78 described above.

It is important that the severing means 78 be disposed at a position which allows stretching of the prong material to occur prior to the prong 22 being severed from the moil. If the severing means 78 is disposed too far from the plane of the substrate 24, the prong material will pass underneath the severing means 78 and not be intercepted by it, forming a very long engaging means 30 which will not be properly spaced from the substrate 24 or adjacent prongs 22. Conversely, if the severing means 78 is disposed too close to the plane of the substrate 24, the severing means 78 will truncate the shank 28 and an engaging means 30 may not be formed.

A hot wire severing means 78 disposed approximately 14 millimeters to 22 millimeters (0.56 to 0.88 inches), preferably about 18 millimeters (0.72 inches) in the machine direction from the nip point 70, approximately 4.8 millimeters to 7.9 millimeters (0.19 to 0.31 inches), preferably about 6.4 millimeters (0.25 inches) radially outward from the backing roll 74 and approximately 1.5 millimeters to approximately 4.8 millimeters (0.06 to 0.19 inches), preferably about 3.3 millimeters (0.13 inches) radially outwardly from the print roll 72 is adequately positioned for the process of manufacture disclosed herein.

In operation, the substrate 24 is transported in a first direction relative to the depositing means 76. More particularly, the substrate 24 is transported through the nip 70, preferentially drawn by a take-up roll (not shown). This provides a clean area of substrate 24 for continuous deposition of prongs 22 and removes the portions of the substrate 24 having prongs 22 deposited thereon. The direction generally parallel to the principal direction of transport of the substrate 24 as it passes through the nip 70 is referred to as the "machine direction." The machine direction, as indicated by the arrows 75 of FIG. 7, is generally orthogonal the centerline of the print roll 72 and backing roll 74. The direction generally orthogonal to the machine direction and parallel to the plane of the substrate 24 is referred to as the "cross-machine direction."

The substrate 24 may be drawn through the nip 70 at a speed approximately 2% to approximately 10% greater than the surface speed of the rolls 72 and 74. This is done to minimize bunching or puckering of the substrate 24 near the means for severing 78 the prongs 22 from the means for depositing the prong material on the substrate 24. The substrate 24 is transported through the nip 70 in the first direction at about 3 to about 31 meters per minute (10 to 100 feet per minute).

If desired, the substrate 24 may be inclined at an angle $\gamma$, approximately 35° to approximately 55°, preferably about 45°, from the plane of the nip 70 towards the backing roll 74 to utilize the viscoelastic nature of the prong material and properly orient the engaging means 30 in the lateral direction, as well as longitudinal direction. This arrangement also provides a greater force to extract the prong material from the cell 76 and to pull the prong 22 away from the print roll 72. Also, increasing the angle $\gamma$ of deviation from the plane of the nip 70 has a weak, but positive effect to produce engaging means 30 having a greater lateral projection 38.

After depositing prong material from the cell 76 onto the substrate 24, the rolls 72 and 74 continue rotation, in the directions indicated by the arrows 75 of FIG. 7. This results in a period of relative displacement between the transported substrate 24 and the cells 76 during which period (prior to severing) the prong material bridges the substrate 24 and print roll 72. As relative displacement continues, the prong material is stretched until severing occurs and the prong 22 is separated from the cell 76 of the print roll 72. As used herein the term "stretch" means to increase in linear dimension, at least a portion of which increase becomes substantially permanent for the life of the fastening system 20.

As discussed above, it is also necessary to sever the individual prongs 22 from the print roll 72 as part of the process which forms the engaging means 30. When severed, a prong 22 is longitudinally divided into two parts, a distal end and engaging means 30 which remain with the fastening system 20 and a moil (not shown) which remains with the print roll 72 and may be recycled, as desired. After the prongs 22 are severed from the moil, the fastening system 20 is allowed to freeze prior to contact of the prongs 22 with other objects. After solidification of the prongs 22, the substrate 24 may be wound into a roll for storage as desired.

Several parameters of the manufacturing process affect the included angle $\theta$ of the engaging means. For example, as the distance between the hot wire 78 and the substrate 24 is increased, the included angle $\theta$ of the engaging means generally becomes relatively greater. This occurs because as the length of the engaging means, particularly the lateral projection 38, becomes greater, a larger included angle $\theta$ can be accommodated. Also, as the angle $\gamma$ between the substrate and the plane of the nip is increased an engaging means 30 having a relatively greater angle $\theta$ is formed. This occurs because of the relatively greater lateral stretching of the prong material prior to solidification. Also, the influence of gravity has a greater lateral component as the angle $\gamma$ increases.

Conversely, as the temperature of the prong material when deposited increases, an engaging means 30 having a relatively lesser included angle $\theta$ will be formed. This occurs because the hotter material will more easily flow under the influence of gravity towards the substrate, yielding an included angle $\theta$ more nearly about 180°. However, if the rate of cooling of the engaging means is increased when the prong material is deposited on the substrate 24, a relatively greater included angle $\theta$ can be formed. A parameter related to the cooling rate is the rate of transport of the substrate 24. As the substrate is transported at a greater speed, a relatively smaller included angle $\theta$ results. This occurs because there is less time for the prong material to cool prior to being intercepted by the severing means 78.

A nonlimiting illustration of the process which produces a prong 22 having an engaging means 30 within include angle $\theta$ of about 270°±40° shows the prong material to be disposed in the trough 80 and heated by means commonly known to one skilled in the art, to a temperature somewhat above the melting point. If a polyester resin hot melt adhesive is selected, a material temperature of approximately 177°–193° C., preferably about 186° C. has been found suitable. If a polyamide resin is selected, a material temperature of approximately 193°–213° C., preferably about 200° C. has been found suitable. A one side bleached kraft paper substrate 24 about 0.008 to about 0.15 millimeters (0.003 to 0.006 inches) in thickness works well with hot melt adhesive prongs 22. The prongs 22 are joined to the bleached side of the kraft paper substrate 24.

For the illustrated operation described herein, print roll 72 having an array of about 5 cells 76 per centimeter (13 cells 76 per inch) in both the machine direction and cross-machine directions, yielding a grid of about 26 cells 76 per square centimeter (169 cells 76 per square inch), is suitable. This grid density may be advantageously used with a print roll 72 having a diameter of about 16 centimeters (6.3 inches), with cells 76 about 1.1 millimeters (0.045 inches) in diameter and about 0.76 millimeters (0.030 inches) deep. A backing roll 74 having a diameter of about 15.2 centimeters (6.0 inches) and vertically registered has been found to work well with the aforementioned print roll 72. The rate of transport of the substrate 24 is about 3.0 meters per minute (10 feet per minute).

A nickel-chromium hot wire 78 having a diameter of about 0.51 millimeters (0.02 inches) disposed approximately 18.2 millimeters (0.72 inches) from the nip point 70 in the machine direction, approximately 0.33 millimeters (0.13 inches) radially outwardly from the print roll 72 and approximately 6.35 millimeters (0.25 inches) radially outwardly from the backing roll 74 is heated to a temperature of about 382° C. The fastening system 20 produced by this operation is substantially similar to that illustrated by FIG. 1 which fastening system 20 may be advantageously incorporated into the illustrative article of use discussed below.

Without being bound by any particular theory, it is believed that the geometry of the engaging means 30 is governed by the differential cooling of the prong 22. The trailing edge 46 of the prong 22 is shielded and insulated from the heat originating from the severing means 78. Conversely, the leading edge 42 is directly exposed to the heat of the severing means 78, which causes the leading edge 42 to cool more slowly than the rate at which the trailing edge 46 cools. The resulting differential cooling rate causes elongation of the leading edge 42 and contraction of the trailing edge 46, relative to each other. As this differential cooling rate is increased, a relatively longer engaging means 30 is formed, typically yielding a relatively greater included angle $\theta$.

Without being bound by further theory, it is believed that the arcuate shape and curl of the engaging means 30 occur due to differences in stresses which occur upon freezing of the material of the prong 22. It is believed that the material above the neutral axis of the prong is somewhat tensioned while the material below the neutral axis is in compression. This differential stress field pulls and pushes against the material on opposite sides of the neutral axis, changing the lateral orientation and geometry of the engaging means 30 during the freezing of the prong material.

If desired, a fastening system 20 having relatively very small prongs 22 (not shown) may be made by forming a natural pattern from the print roll 72. As used herein, the term "natural pattern" refers to array of prongs 22 resulting from a print roll 72 which does not have cells 76 disposed thereon, but instead which utilizes the surface of the roll 72 as the depositing means 76. Thus, the pattern of prongs 22 is formed by the clearance between the doctor blade 82 and the print roll 72, and to a lesser extent by the surface finish of the print roll 72.

The doctor blade 82 should be adjusted to provide about a gap of about 0.03 millimeters to about 0.08 millimeters (0.001 to 0.003 inches) in radial clearance from the print roll 72. To form a natural pattern, the very small sized prongs 22 resulting from such a print roll 72 are advantageously utilized with a reticulated foam receiving surface that does not have strands and openings therebetween, but rather incurs localized elastic deformations which resist separation of the fastening system 20.

Alternatively, the fastening system 20 of the present invention may be produced by molding techniques generally well known in the art. For example, a fastening system system according to the present invention may be constructed by the method disclosed in U.S. Pat. No. 4,056,593 issued on Nov. 1, 1977 to de Navas Albareda and incorporated herein by reference to illustrate an alternative process of manufacture, teaches producing a fastening system 20 by extruding a strip of material from a die having a cross section corresponding to the desired shape of the fastening system. The strip of extruded material is then transversely cut to form notches defining individual and substantially similarly shaped prong elements.

U.S. Pat. No. 4,462,784 issued on July 31, 1984 to Russell, incorporated herein by reference to illustrate a second alternative process of manufacture which may be used to construct a fastening system 20 according to the present invention, teaches continuous molding of objects using a rotatable wheel with peripheral orifices, referred to as cavities. The cavities are complementary in shape to the desired finished product. Plastic is extruded through an orifice, filling the cavity and solidifying therein. After molding, selected portions of the objects to be formed are selectively stretched.

What is claimed is:

1. A fastening system for attaching to a complementary receiving surface, said fastening system comprising:

a substrate comprising a sheet of flexible material; and a multiplicity of prongs joined to said substrate, each of said prongs being made of thermoplastic hot melt adhesive deposited onto said substrate, each of said prongs comprising (a) a base comprising the plane of attachment of said prong to said substrate such that said prong is joined at said base to said substrate;

(b) a shank having a proximal end and a distal end, said proximal end being contiguous with said base, said shank projecting longitudinally outwardly from said base and said substrate; and (c) an engaging means for securing the fastening system to a complementary receiving surface so as to cause mechanical interference between said engaging means and the receiving surface, said engaging means being joined to said distal end of said shank such that said engaging means laterally projects radially outwardly beyond the periphery of said shank and away from said substrate, said engaging means having a reentrant segment, said reentrant segment having a distal end terminating at a tip, said reentrant segment being laterally directed towards said shank such that said engaging means defines a free space and forms an included angle greater than about 270° and less than about 360°;

wherein said prong has a longitudinal axis comprising an imaginary line generally centered at said base at an origin and laterally and longitudinally extending through said distal end of said shank to said tip of said engaging means, a profile projection of said longitudinal axis being formed beyond said tip;

wherein said substrate has a perpendicular which passes through said origin of said longitudinal axis; and wherein said included angle is measured as the angle between said profile projection of said longitudinal axis through said tip of said reentrant segment and said perpendicular to said substrate which passes through said origin of said longitudinal axis.

2. The fastening system of claim 1 wherein said shank nonperpendicularly projects longitudinally outwardly from said substrate.

3. The fastening system of claim 1 wherein said prong has a generally arcuate profile.

4. The fastening system of claim 3 wherein said shank nonperpendicularly projects longitudinally outwardly from said substrate.

5. The fastening system of claim 1 wherein said included angle is between about 270° and 310°.

6. The fastening system of claim 1 wherein the shortest distance taken perpendicular to the plane of said substrate through which a portion of said receiving surface must pass to enter said free space, the minimum longitudinal dimension, is about 0.2 mm to about 0.8 mm.

7. The fastening system of claim 1 wherein the shortest distance taken parallel to the plane of the substrate through which a portion of said receiving surface must pass to enter said free space, the minimum lateral dimension, is between about 0.2 mm and about 0.8 mm.

8. The fastening system of claim 1 wherein said thermoplastic hot melt adhesive material is a polyester hot melt adhesive.

9. The fastening system of claim 1 wherein said engaging means having a minimum longitudinal dimension between about 0.2 mm and about 0.8 mm and a minimum lateral dimension between about 0.2 mm and about 0.8 mm.

10. The fastening system of claim 1 wherein said prong has a generally arcuate profile.

11. The fastening system of claim 10 wherein said shank nonperpendicularly projects longitudinally outwardly from said substrate.

12. The fastening system of claim 11 wherein said thermoplastic hot melt adhesive material comprises a polyester hot melt adhesive.

* * * * *